US008201532B2

(12) United States Patent
Prokop

(10) Patent No.: US 8,201,532 B2
(45) Date of Patent: Jun. 19, 2012

(54) ROTATIONALLY LOCKED TAPPET OF A VALVE TIMING MECHANISM

(75) Inventor: Mario Prokop, Neckarsulm (DE)

(73) Assignee: Mahle International GmbH (DE)

( * ) Notice: Subject to any disclaimer, the term of this patent is extended or adjusted under 35 U.S.C. 154(b) by 87 days.

(21) Appl. No.: 12/519,602

(22) PCT Filed: Dec. 6, 2007

(86) PCT No.: PCT/EP2007/063455

§ 371 (c)(1),
(2), (4) Date: Dec. 7, 2009

(87) PCT Pub. No.: WO2008/074651

PCT Pub. Date: Jun. 26, 2008

(65) Prior Publication Data

US 2010/0294219 A1 Nov. 25, 2010

(30) Foreign Application Priority Data

Dec. 18, 2006 (DE) ..... 10 2006 059 716

(51) Int. Cl.
*F01L 1/14* (2006.01)

(52) U.S. Cl. ..... 123/90.5

(58) Field of Classification Search ..... 123/90.5, 123/90.48

See application file for complete search history.

(56) References Cited

U.S. PATENT DOCUMENTS

| | | | | |
|---|---|---|---|---|
| 3,267,919 | A | 8/1966 | Wortman | |
| 3,886,808 | A | 6/1975 | Weber | |
| 4,089,234 | A | 5/1978 | Henson et al. | |
| 4,771,741 | A | 9/1988 | Leer | |
| 5,651,335 | A * | 7/1997 | Elendt et al. | 123/90.16 |
| 6,244,229 | B1 | 6/2001 | Nakano et al. | |
| 7,159,552 | B2 * | 1/2007 | Backert et al. | 123/90.5 |
| 7,210,437 | B2 * | 5/2007 | Geyer | 123/90.5 |
| 7,900,592 | B2 * | 3/2011 | Boesel | 123/90.5 |

FOREIGN PATENT DOCUMENTS

| | | |
|---|---|---|
| DE | 3307852 | 9/1984 |
| DE | 3622245 | 4/1990 |
| DE | 4118370 | 12/1992 |

(Continued)

OTHER PUBLICATIONS

English abstract provided for DE-4118370.
English abstract provided for DE-19921215.
English abstract provided for DE-19804952.
English abstract provided for DE-19600852.

(Continued)

*Primary Examiner* — Thomas Denion
*Assistant Examiner* — Daniel Bernstein
(74) *Attorney, Agent, or Firm* — Rader, Fishman & Grauer PLLC

(57) ABSTRACT

An anti-rotationally secured tappet of a valve drive of an internal combustion engine may include a bucket tappet including an external lateral surface. A floor and a skirt for may be arranged between a cam and a valve of the valve drive and guided in a receiving bore of a cylinder head. The skirt may include an internal lateral surface and the cylinder head may include a guide groove. A radially outward protruding anti-rotation component may be arranged in a recess of the skirt that glides in the guide groove of the cylinder head. Two spring arms may be included with the anti-rotation component and extend in a circumferential direction of the tappet.

14 Claims, 8 Drawing Sheets

FOREIGN PATENT DOCUMENTS

| | | |
|---|---|---|
| DE | 19501061 | 7/1996 |
| DE | 19548808 | 7/1997 |
| DE | 19600852 | 7/1997 |
| DE | 19804952 | 8/1999 |
| DE | 19921215 | 11/2000 |
| DE | 10358934 | 7/2005 |
| DE | 102005033373 | 3/2006 |

OTHER PUBLICATIONS

English abstract provided for DE19548808.
English abstract provided for DE-19501061.
English abstract provided for DE-102005033373.
English abstract provided for DE-3307852.
English abstract provided for DE-10358934.

* cited by examiner

ROTATIONALLY LOCKED TAPPET OF A VALVE TIMING MECHANISM

CROSS-REFERENCE TO RELATED APPLICATIONS

This application is a National Stage application which claims the benefit of International Application No. PCT/EP2007/063455 filed Dec. 6, 2007, which claims priority based on German Patent Application No. 102006059716.8, filed Dec. 18, 2006, both of which are hereby incorporated by reference in their entirety.

TECHNICAL FIELD

The invention relates to an anti-rotationally secured tappet of a valve drive of an internal combustion engine according to the preamble of the claim 1 as well as to an anti-rotationally secured tappet according to the preamble of claim 1.

BACKGROUND

Document DE 196 00 852 A1 teaches of an anti-rotationally secured tappet of a valve drive of an internal combustion engine, preferably a bucket tappet composed of a base and a skirt, that is arranged between a cam and a valve and is guided in a receiving bore of a cylinder head. An anti-rotation component is arranged in a recess of the skirt, which anti-rotation component is guided in a guide groove of the cylinder head. The anti-rotation component is designed as an elastic spring element and consists of a back as well as two clips attached thereto, which clips are clipped into two longitudinal slits in the skirt of the tappet. It is disadvantageous that constructed space is greatly limited owing to the length of the clips on the interior of the tappet and, moreover, the two legs of both clips must have a high degree of spring preload in order to ensure a necessarily tight fit of the anti-rotation component so that with thin-walled skirts, in particular, an unacceptably high demand of the material of the skirt cannot be excluded.

Document DE 195 01 061 A1, for example, teaches of a further anti-rotationally secured tappet.

SUMMARY

The invention is concerned with the object of providing for an anti-rotationally secured tappet of the generic type an improved embodiment in which an anti-rotation component can be designed in a constructively simple manner and can be simply and securely connected to the tappet with unnecessarily high stress peaks being placed on the material of the tappet.

According to the invention, this objective is solved by the subject matter of the independent claims. Advantageous embodiments of the invention are the subject matter of the dependent claims.

The invention is based on the general idea of providing in an anti-rotation component two spring arms that extend in the circumferential direction of a tappet, which spring arms guarantee for an anti-rotation component mounted on the tappet that said anti-rotation component is locked into position above the two spring arms. Both spring arms abut at least regionally either an external lateral surface of the tappet or an internal lateral surface of the skirt of the anti-rotationally secured tappet and lock the anti-rotation component into position on the tappet by means of a radial clamping craft that acts thereon. The skirt in this instance also comprises a transition region to a floor of the tappet. In so far as the two spring arms of the anti-rotation component abut the internal lateral surface, said spring arms have a greater radius than the interior lateral surface, which permits the spring arms to load by pushing radially outward against the interior lateral surface of the skirt of the tappet. In an anti-rotational securing with spring arms abutting the external lateral surface, said spring arms have a smaller radius than the exterior lateral surface, so that with an anti-rotation component locked into position on the tappet, they clampingly grip the tappet and press with a radially-inward directed force against the external lateral surface of the skirt/tappet. With the anti-rotation component according to the invention, owing to the circumferentially radially abutting spring arms, a high degree of clamping force can be transferred without having to accept regional surface pressure and concomitant material overstressing. Moreover, such an anti-rotation component can be manufactured as an inexpensive formed sheet metal part, thereby permitting a reduction in production costs in particular.

A radial annular groove that at least partially receives the spring arms of the anti-rotation component is advantageously arranged on the internal lateral surface of the skirt. Such an annular groove considerably simplifies the mounting of the anti-rotation component on the tappet and locks said anti-rotation component into position in an axial direction on the tappet when in an assembled state. Moreover, such a radial annular groove can be integrated without additional expenditures into an anti-rotation component of the tappet, which component is required in any case, in such a manner that no appreciable additional costs result. The annular groove furthermore makes a forced positioning of the anti-rotation component possible since said annular groove necessarily determines a predetermined and predefined position of the anti-rotation component in an assembled state. In an anti-rotation component with spring arms abutting the external lateral surface, a radially outwardly open annular groove is provided on the external lateral surface that completely receives the spring arms of the anti-rotation component in such a manner that said spring arms do not radially protrude beyond an external circumference of the external lateral surface at any location.

The invention is furthermore based on the general idea of providing the anti-rotation component as a lug-like insert element, that is to say without spring arms, the insert element being held in a form-fitting and/or force-fitting manner on the tappet in a radially outwardly open and radially inwardly closed groove. Such a design of the anti-rotation component simplifies the latter immensely, it being possible to achieve a force-fit between the anti-rotation component and the groove by means of soldering, cementing or welding, for example. This anti-rotation component is arranged in the floor region of a tappet having a floor and a skirt adjacent to said floor. A connection in the form of a dovetail is conceivable between the anti-rotation component and the corresponding groove, the anti-rotation component having a dovetail-like cross-section while the groove has an undercut cross-section corresponding thereto so that the anti-rotation component is form-fittingly held in the groove.

Advantageous exemplary embodiments are illustrated in the drawings and explained in greater detail below.

BRIEF DESCRIPTION OF THE DRAWINGS

The figures show in schematic diagrams

DETAILED DESCRIPTION

Figure 1:
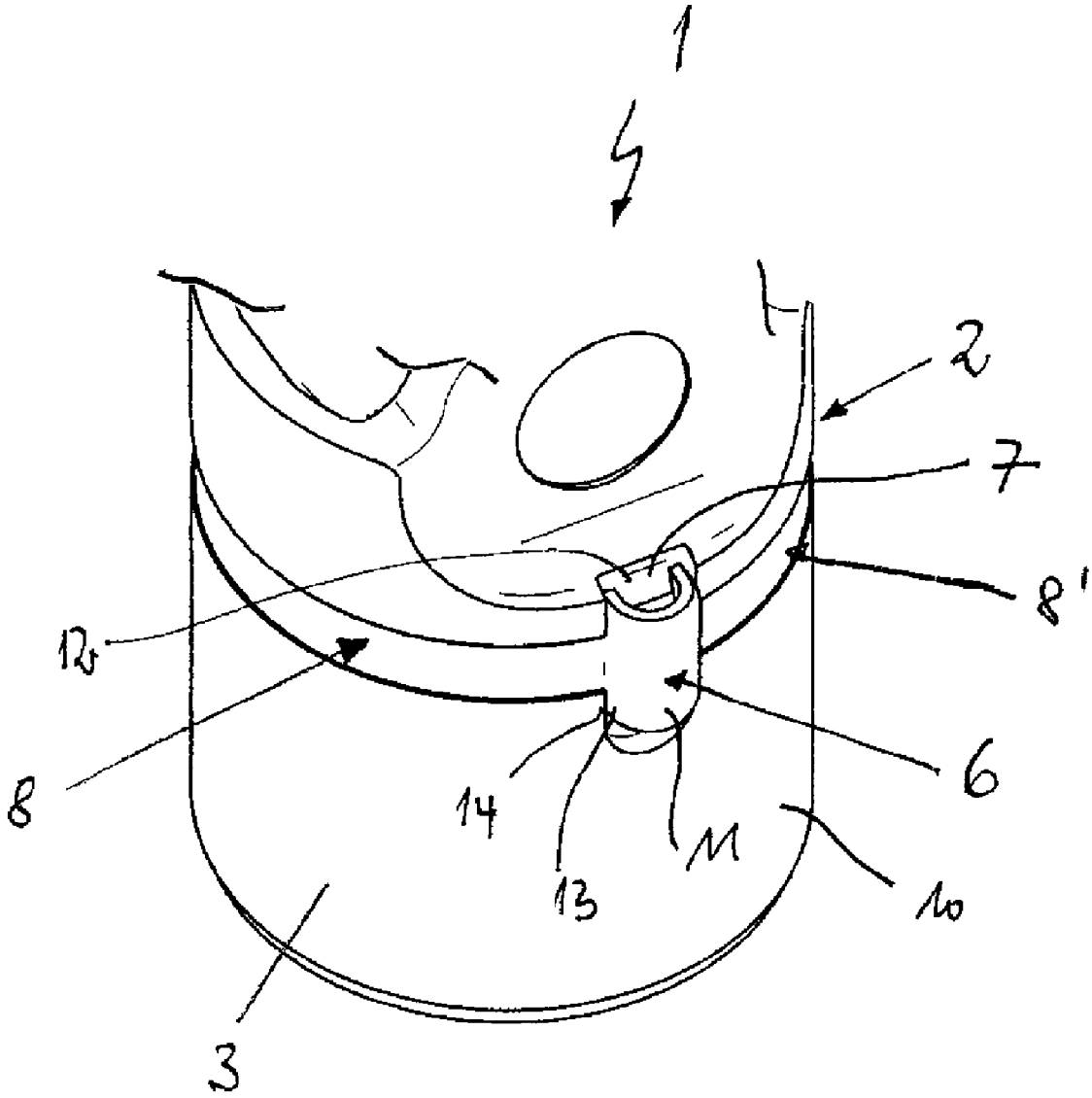
FIG. 1 a partial view of an anti-rotationally secured tappet according to the invention with an anti-rotation component as an external clip, FIGS. 2*a* to *c* different illustrations of the anti-rotation component according to FIG. 1, FIGS. 3*a* to *d* a sectional representation through an anti-rotation component and an anti-rotationally secured tappet according to FIG. 1, FIG. 4 an anti-rotation component as interior clip, FIG. 5 an illustration as in FIG. 4, however from a different perspective, FIG. 6*a* a longitudinal cross section view through an anti-rotationally secured tappet according to FIG. 4, FIG. 6*b* an anti-rotation component as interior clip, FIG. 7 an anti-rotation component according to FIG. 6*b* in an anti-rotationally secured tappet according to FIG. 6*a*, FIG. 8 a cross-section through an anti-rotationally secured tappet according to FIG. 7 in the region of the anti-rotation component, FIG. 9 a view of an anti-rotationally secured tappet with an anti-rotation component arranged therein, FIG. 10 an illustration as in FIG. 7, however of a different embodiment, FIGS. 11*a, b* an illustration as in FIGS. 6*a, b*, however of a different embodiment, FIG. 12 a cross-sectional illustration through an anti-rotationally secured tappet according to FIG. 10 in the region of the anti-rotation component, FIG. 13 an illustration as in FIG. 9, however of a different embodiment, FIG. 14 an anti-rotationally secured tappet with an anti-rotation component designed as an insert element, FIGS. 15*a* to *c* a cross-section through an anti-rotationally secured tappet according to the invention in the region of the insert element.

Corresponding to FIG. 1, an anti-rotationally secured tappet 1 of a valve drive of an internal combustion engine, which is incidentally not shown, has a floor 2 and a skirt 3. The anti-rotationally secured tappet 1 is preferably designed as a bucket tappet and is customarily arranged between a cam, which is not shown, and a valve, which is likewise not shown, for example between a control cam and a gas exchange valve. In this arrangement, the tappet 1 conducts an oscillating back-and-forth motion in an unshown receiving bore of a cylinder head 4 (cf. FIG. 3*d*), a guide groove being provided in the cylinder head 4 in which guide groove a radially outward protruding anti-rotation component 6 of the anti-rotationally secured tappet 1 engages. The anti-rotation component 6 is arranged in a recess 7 of the skirt 3 of the tappet 1.

According to FIG. 1, the anti-rotation component 6 has two spring arms 8, 8' that extend in the circumferential direction of the skirt 3 or of the tappet 1, which spring arms abut at least in regions an external lateral surface 10 of the tappet 1 and lock the anti-rotation component 6 into position on the tappet 1 by means of a clamping force that acts radially inward on the skirt 3 or on the tappet 1. For this purpose, a radially-inward recoiling annular groove 9 is provided that is on the external lateral surface 10 of the skirt 3 or of the tappet 1 and that entirely contains the spring arms 8, 8' of the anti-rotation component 6 (cf. FIG. 2*b*) in such a manner that the spring arms 8, 8' do not protrude in a radial direction beyond an external lateral surface of the tappet 1 at any location.

Figure 2:
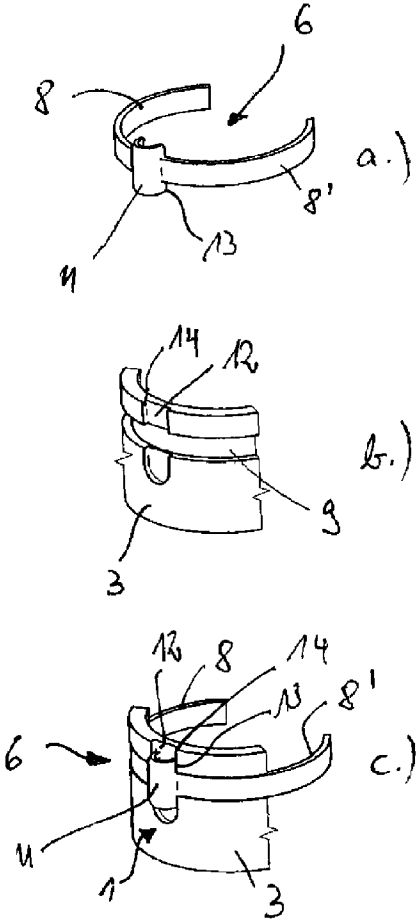
Figure 4:
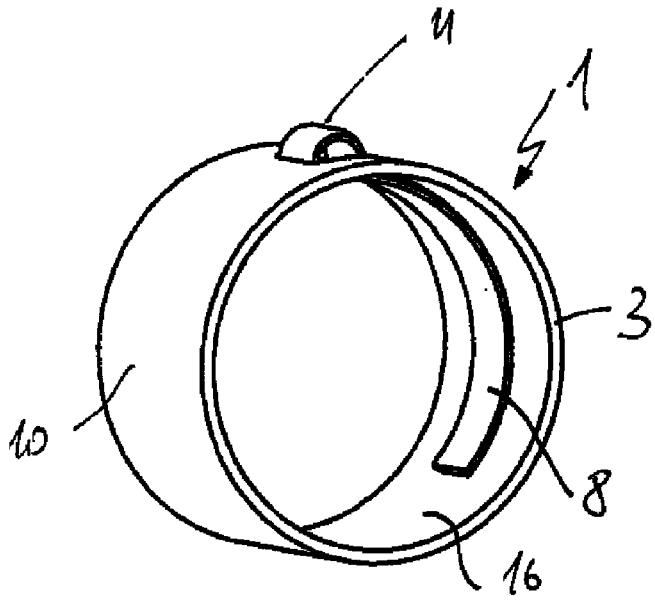
Figure 5:
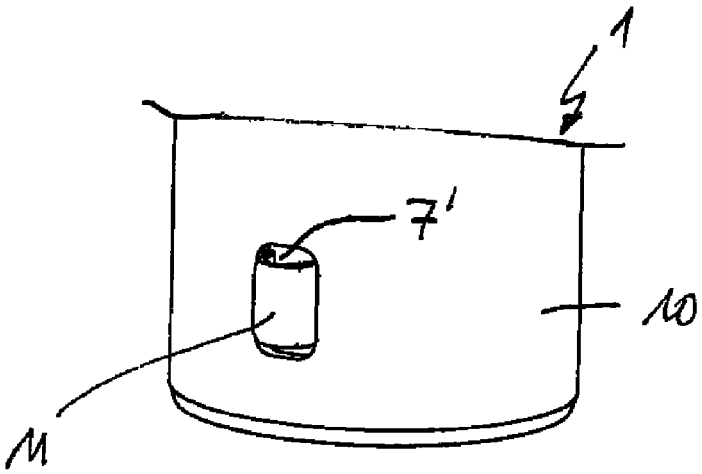
Figure 7:
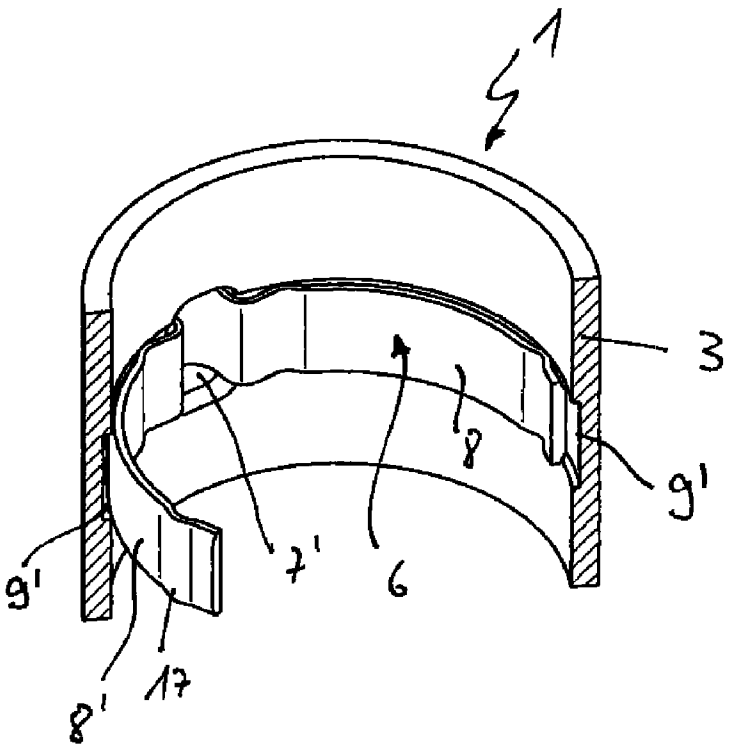
Figure 6:
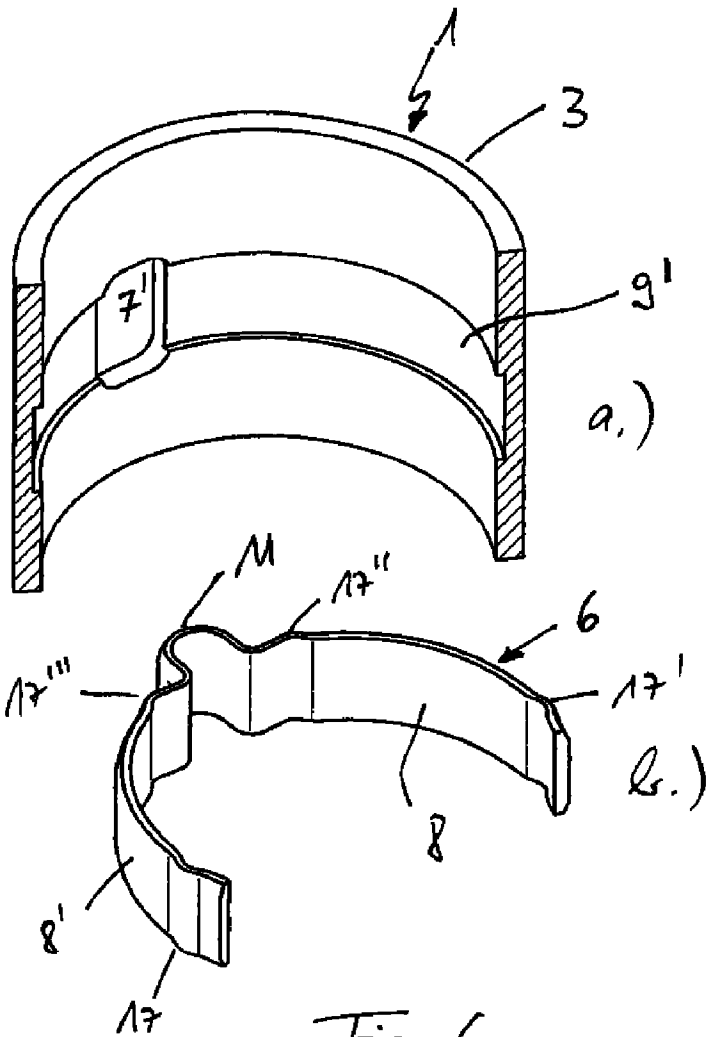

FIG. 2*a* shows such an anti-rotation component 6 with its circumferentially extending spring arms 8, 8' that meet in the region of a back 11 that protrudes radially outward. The anti-rotation component 6 can be designed as a formed sheet metal part, the two spring arms 8, 8' in an anti-rotation component 6 according to FIGS. 1 to 3 having a smaller radius than the external lateral surface 10, so that in the instance of an anti-rotation component 6 mounted on the tappet 1, the spring arms 8, 8' press with a force directed radially inward on the exterior lateral surface or on the annular groove 9 arranged therein.

According to FIGS. 2*b* and *c*, the back 11 is positioned in a radially inward recoiling axial groove, said back abutting in at least one back region, in particular a lateral back region, in a form-fitting manner a longitudinal edge 14 of the axial groove 12. Because of this, the anti-rotation component 6 in the mounted state is ensured against displacement in the circumferential direction.

FIG. 3*a* shows a cross-section through the anti-rotationally secured tappet 1 in the region of the annular groove 9, the radially inward recoiling axial groove 12 also being shown. The anti-rotation component 6 according to FIG. 3*b* is preferably designed as a formed sheet metal part, the back 11 engaging a locking element 15 that engages on one side the axial groove 12 and is enclosed by the back 11 of the anti-rotation component 6 on the other, thereby securing said anti-rotation component against displacement in the circumferential direction. FIG. 3*d* shows an anti-rotation component 6 and how it is guided with its back 11 in the guide groove 5 of the cylinder head 4, thereby securing the tappet 1 against rotation. Customarily, the spring arms 8, 8' of the anti-rotation component 6 are designed to be so long in the circumferential direction that together they form a clip covering at least more than 180° (cf. FIG. 2*a*).

Figure 3:
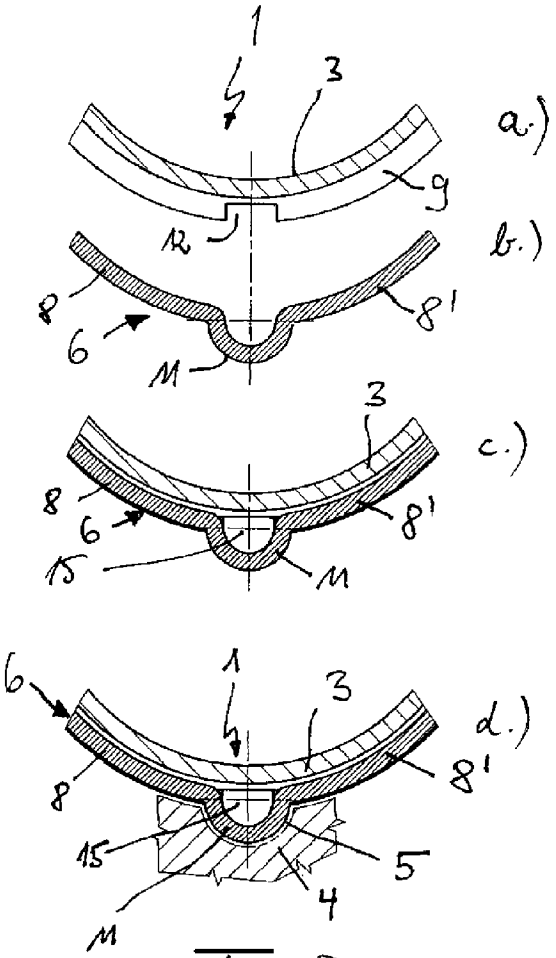

The anti-rotation component 6 according to FIGS. 1 to 3 thus consists of the two spring arms 8, 8' and the back 11 connecting them. The back 11 is preferably designed to be complementary to the cross-section profile of the guide groove 5, which thereby can ensure a precise guiding of the tappet 1 in the receiving bore on the cylinder head 4. The annular groove 9 can generally be designed as either completely or only partially circumferential. In the instance of an anti-rotation component 6 that is not integrated, both of the spring arms 8, 8' have a smaller radius than the outer radius of the tappet 1, thereby exerting a clamping force on the skirt 3 when clipped thereon, which in turn reliably locks the anti-rotation component 6 into position onto the skirt 3 or on the tappet 1. A circumferential rotation of the anti-rotation component 6 is prevented by the back 11, which is overall more widely designed, of the anti-rotation component 6 that is supported in the axial groove 12 or on the longitudinal edge of the axial groove 12. In the case of an annular groove 9 that is only partially circumferential, a safeguarding against rotation in the circumferential direction of the anti-rotation component 6 could be realised through correspondingly limited spring arms 8, 8' in such a manner that in such an instance, a wider design of the back 11 can be dispensed with, which advantageously affects the producibility of the anti-rotation component 6. Generally, the shape of the back 11, which forms the guide surface in the guide groove 5, can be designed either cylindrically, partially cylindrical multiformly or rectangularly as well.

The advantage of the anti-rotation component according to the invention lies in the fact that due to its design, an axial displacement of the anti-rotation component 6 as well as a displacement thereof owing to the annular groove 9 or the axial groove 12 is not possible. A high degree of retention force can also be achieved through the spring clamping force of both spring arms 8, 8', which force acts radially circumferentially on a large surface, while because of the large surface, the surface pressure is relatively minimal so that no deformations of the tappet 1 are to be expected. Moreover, during the operation of the anti-rotation component 6, no unhinging of the anti-rotation component 6 is possible.

Assembling the CRS 6 is very simple and is possible without the use of complex apparatuses and tools owing to its self-positioning in the annular groove 9 and the axial groove 12 as well as the spring loads of the two spring arms 8, 8'.

According to FIGS. 4 to 11, a variant of the anti-rotation component 6 is shown in which both spring arms 8, 8' abut at least in regions an internal lateral surface 16 of the skirt 3 and lock the anti-rotation component 6 into position on the skirt 3 by means of a clamping force that acts radially outward on the skirt 3. In the embodiments or variants shown in these figures, both spring arms 8, 8' have a radius that is greater than the external radius of the tappet 1 so that when the anti-rotation component 6 is in the assembled state, the two spring arms 8, 8' abut with inward pressure the interior lateral surface 16. The back 11 protrudes radially outwardly through the recess 7' designed as a through-opening through the skirt 3, thereby safeguarding against a rotation of the tappet 1 in the receiving bore of the cylinder head 4. According to FIG. 6*a* in which a longitudinal cross section view through the tappet 1 according to the invention is shown, a radially-outward recoiling annular groove 9' is provided on the internal lateral surface, in which tappet the two spring arms 8, 8' engage the anti-rotation component 6. In so doing, both of the spring arms 8, 8' can each have a radially-outward projecting projection 17, 17' on each of their free ends so that the spring arms 8, 8' abut, for example, only in the region of these projections 17, 17' or additional projections 17'', 17''' on the interior lateral surface 16 or on the annular groove 9 (cf. FIG. 8). It is also conceivable that in the region of the outwardly projecting projections 17, 17' on the spring arms 18, 18' in the skirt 3, a respectively corresponding recess 18, 18' is provided in which the anti-rotation component 6 engages with its projections 17, 17'.

Figure 9:
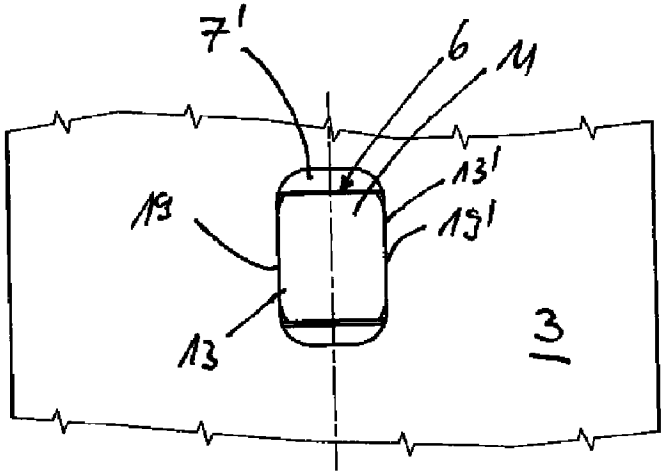
Figure 8:
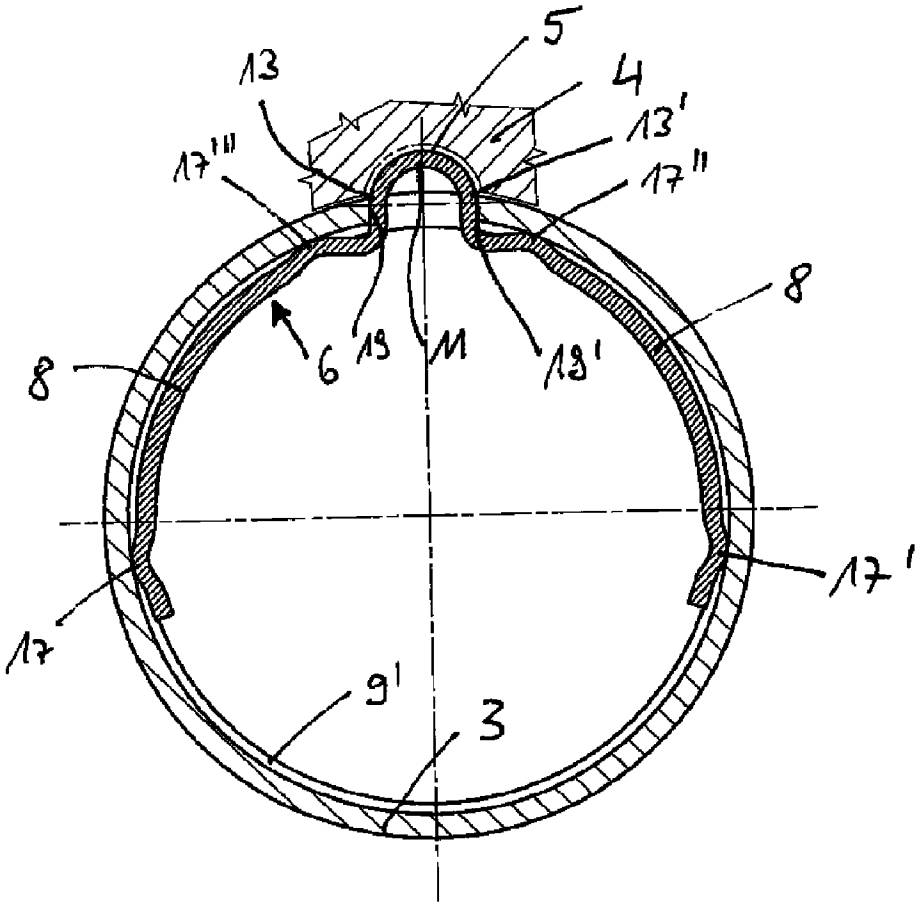
Figure 10:
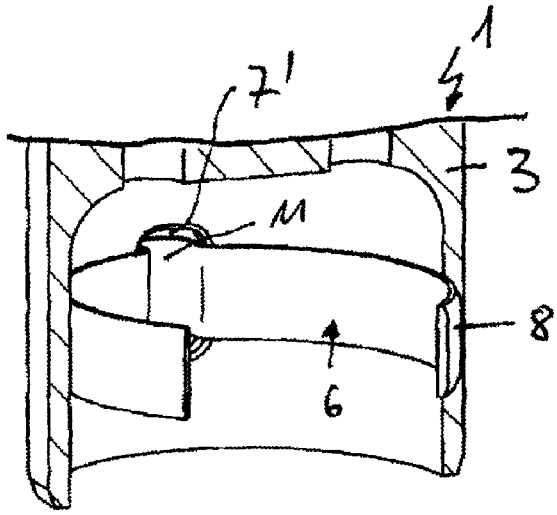
Figure 11:
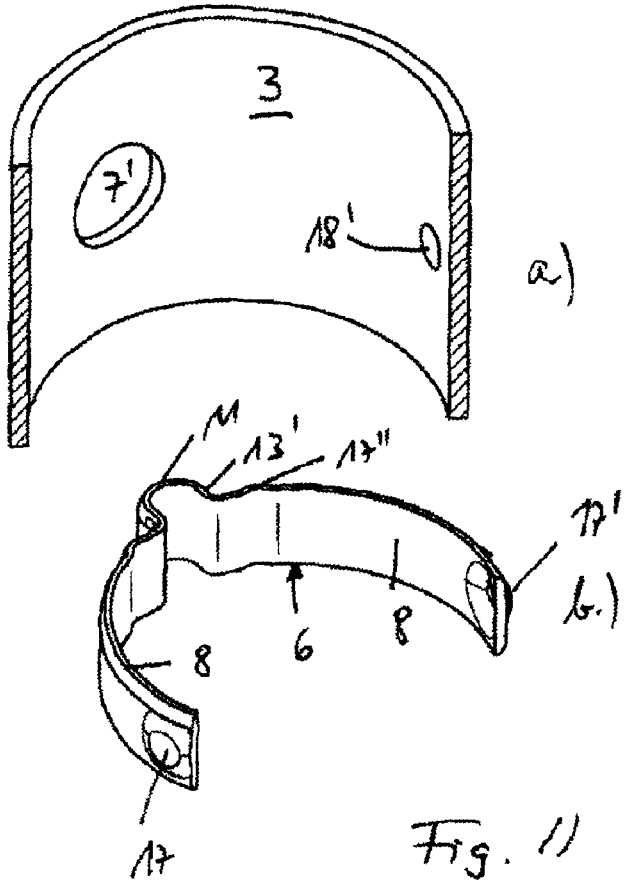
Figure 13:
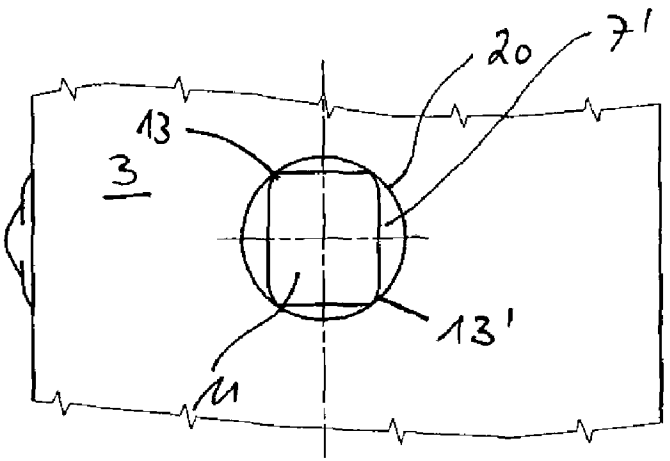
Figure 12:
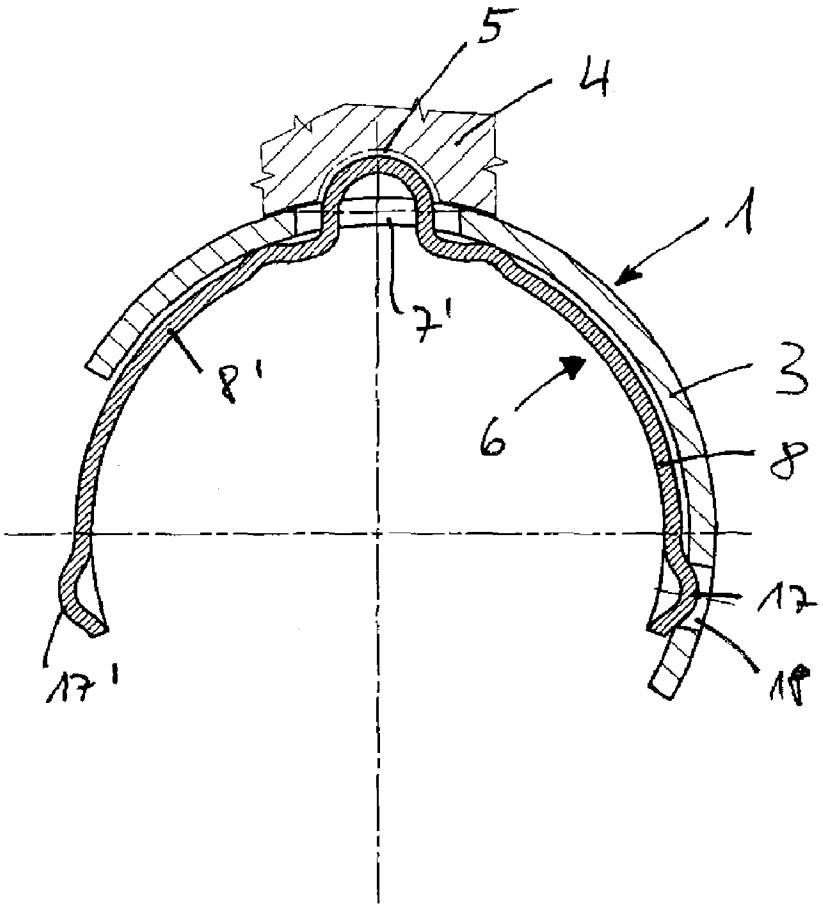

According to FIG. 8, the anti-rotation component 6 has on each spring arm 8, 8' two projections 17 that permit said spring arms 8, 8' to abut the interior lateral surface 16 merely in regions. In this embodiment, the recess 7 in the skirt 3 according to FIG. 9 is designed in such a manner that the lateral back regions 13, 13' of the anti-rotation component 6 abut the respective longitudinal edge 19, 19' of the recess 7', thereby preventing a rotation of the anti-rotation component 6 in the circumferential direction. A similar illustration is also offered in FIGS. 6 and 7.

In contrast thereto, according to FIGS. 10 to 13, recesses 18 are provided in the skirt 3 in which the projections 17, 17' arranged on the free ends of the two spring arms 18, 18' engage, by means of which a rotation of the anti-rotation component 6 in the circumferential direction is prevented. According to FIG. 13, the recess 7 is designed as circular, the back 11 likewise having back regions 13 and 13' that abut an edge 20 of the through-opening 7 and also by virtue of this fact, a rotation of the anti-rotation component 6 in the circumferential direction can be prevented.

Figure 15:
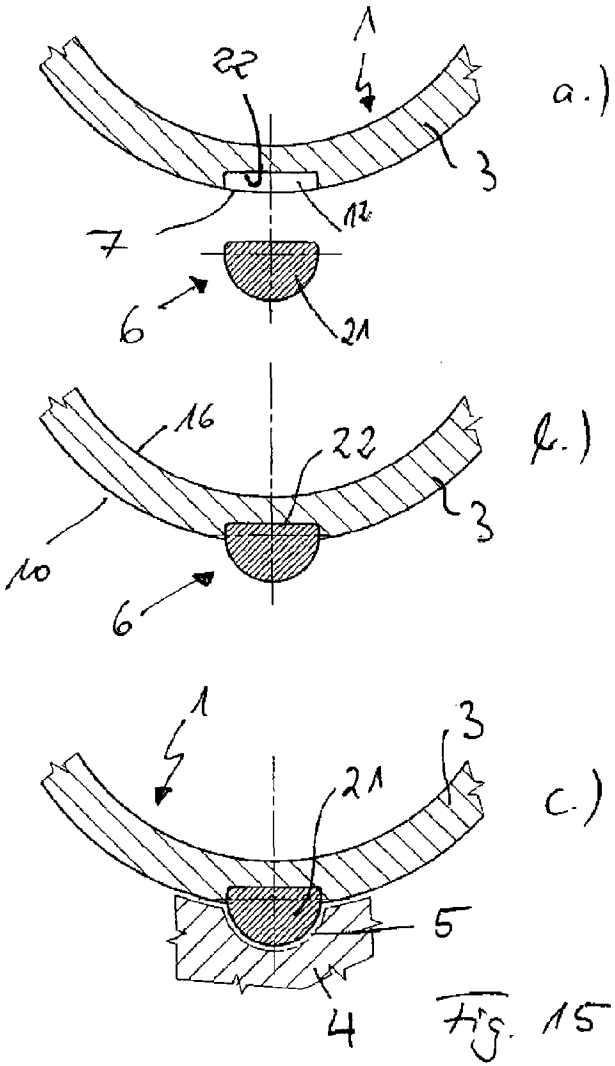
Figure 14:
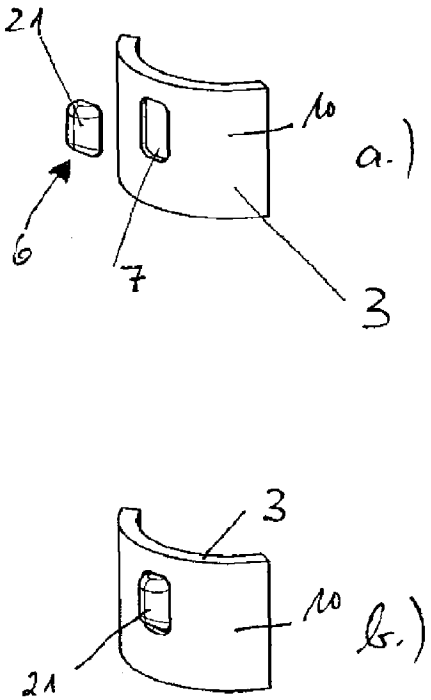

According to the embodiment of the anti-rotation component 6 in FIGS. 14 and 15, the anti-rotation component 6 is designed as a lug-like insert element 21 that is form-fittingly and/or force-fittingly held on the tappet 1 in a radially outwardly open and radially inwardly closed groove, in particular an axial groove 12. The radially outwardly open and radially inwardly closed groove 12 is arranged in the floor region of the tappet 1, that is to say in the region in which the wall thickness of the skirt 3 or of the floor 2 is considerably greater than in the remaining skirt region. The anti-rotation component 6 preferably consists of a solid insert element 21, one of the surfaces of the insert element 21 facing the tappet 1 preferably being designed as a plane surface that is placed on a likewise planar groove base 22. A securing of the anti-rotation component 6 or of the insert element 21 in the groove 12 can be achieved by means of soldering, welding and/or cementing, for example. It is also conceivable that the groove 12 is designed as an undercut groove, for example in the style of a dovetail joint, and the insert element 21 has a spring designed complementary thereto, by means of which not only a force-fit but a form-fit as well can be achieved between the insert element 21 and the tappet 1. It is also conceivable that the groove 12 is designed as the recess that surrounds the insert element 21 on all sides in such a manner that even if the material connection fails, no unhinging of the insert element 21 is possible. The groove 12 or a comparable recess in the tappet 1 can be manufactured simply by an economical milling process, while the insert element 21 can be produced as an inexpensive solid formed part. The assembly of the insert element 21 is possible simply owing to the self-positioning of the anti-rotation component 6 in the groove 12 or in the recess 7, by means of which assembly outlay is also reduced.

All of the features represented in the description and in the following claims can be pertinent to the invention individually and collectively in arbitrary combination.

The invention claimed is:

1. An anti-rotationally secured tappet of a valve drive of an internal combustion engine, comprising:

a bucket tappet including an external lateral surface, a floor and a skirt for being arranged between a cam and a valve of the valve drive, and is guided in a receiving bore of a cylinder head, the skirt including an internal lateral surface, and the cylinder head including a guide groove;

a radially outward protruding anti-rotation component that is arranged in a recess of the skirt that glides in the guide groove of the cylinder head, two spring arms included with the anti-rotation component and that extend in a circumferential direction of the tappet, that abut at least in regions of at least one of the internal lateral surface of the skirt and the external lateral surface of the tappet, and that lock the anti-rotation component into position on the tappet by a clamping force that acts radially on the tappet, and wherein a radial annular groove is provided on the internal lateral surface of the skirt that at least partially contains the spring arms of the anti-rotation component.

2. The tappet as specified in claim 1, wherein the spring arms of the anti-rotation component together form a clip covering at least more than 180°.

3. The tappet as specified in claim 1, the anti-rotation component having spring arms that abut the interior lateral surface of the skirt, a back is provided that protrudes radially outwardly and force-fittingly engages a through-opening at least in the circumferential direction.

4. The tappet as specified in claim 3, wherein the two spring arms each include in a region of free ends, a radially-outward projecting projection that engages in a corresponding recess in the skirt of the tappet.

5. The tappet as specified in claim 1, the anti-rotation component having spring arms that abut the exterior lateral surface of the skirt includes a back that protrudes radially outwardly and includes a back region that engages with a radially recoiling axial groove on the external lateral surface of the skirt.

6. The tappet as specified in claim 5, wherein the back region is form-fittingly connected in the circumferential direction with the axial groove.

7. The tappet as specified in claim 1, wherein the two spring arms each include in a region of free ends, a radially-outward projecting projection that engages in a corresponding recess in the skirt of the tappet.

8. The tappet as specified in claim 2, the anti-rotation component having spring arms that abut the interior lateral surface of the skirt, a back is provided that protrudes radially outwardly and force-fittingly engages a through-opening at least in the circumferential direction.

9. The tappet as specified in claim 2, the anti-rotation component having spring arms that abut the exterior lateral surface of the skirt includes a back that protrudes radially outwardly and includes a back region that engages with a radially recoiling axial groove on the external lateral surface of the skirt.

10. The tappet as specified in claim 9, wherein the back region is form-fittingly connected in the circumferential direction with the axial groove.

11. The tappet as specified in claim 2, wherein the two spring arms each include in a region of free ends, a radially-outward projecting projection that engages in a corresponding recess in the skirt of the tappet.

12. An anti-rotationally secured tappet of a valve drive of an internal combustion engine, comprising:

a bucket tappet including a floor and a skirt for being arranged between a cam and a valve of the valve drive and is guided in a receiving bore of a cylinder head, wherein an anti-rotation component is arranged in a recess that glides in a guide groove of the cylinder head, the skirt including an internal lateral surface, two spring arms included within the anti-rotation component, wherein the anti-rotation component is a lug-like insert element that is at least one of form-fittingly and force-fittingly held on the tappet in a radially outwardly open and radially inwardly closed recess, wherein the recess is arranged in a floor region of the tappet, and a radial annular groove provided on the internal lateral surface of the skirt that at least partially contains the spring arms of the anti-rotation component.

13. The tappet as specified in claim 12, wherein the insert element is one of cemented, soldered and welded to the tappet.

14. An anti-rotationally secured tappet of a valve drive of an internal combustion engine, comprising:

a bucket tappet including an external lateral surface, a floor and a skirt for being arranged between a cam and a valve of the valve drive, and is guided in a receiving bore of a cylinder head, the skirt including an internal lateral surface, and the cylinder head including a guide groove;

a radially outward protruding anti-rotation component that is arranged in a recess of the skirt that glides in the guide groove of the cylinder head, two spring arms included with the anti-rotation component and that extend in a circumferential direction of the tappet, that abut at least in regions of at least one of the internal lateral surface of the skirt and the external lateral surface of the tappet, and that lock the anti-rotation component into position on the tappet by a clamping force that acts radially on the tappet, and wherein the spring arms abut the exterior lateral surface of the tappet and the anti-rotation component includes a back that protrudes radially outwardly and includes a back region that engages with a radially recoiling axial groove on the external lateral surface of the skirt.

* * * * *